US010513420B2

(12) United States Patent
Kleewein

(10) Patent No.: US 10,513,420 B2
(45) Date of Patent: Dec. 24, 2019

(54) FLOOR COVER FOR A PASSENGER-CONVEYING DEVICE

(71) Applicant: Inventio AG, Hergiswil (CH)

(72) Inventor: Gerhard Kleewein, Pressbaum (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 16/343,170

(22) PCT Filed: Oct. 3, 2017

(86) PCT No.: PCT/EP2017/075025
§ 371 (c)(1),
(2) Date: Apr. 18, 2019

(87) PCT Pub. No.: WO2018/072988
PCT Pub. Date: Apr. 26, 2018

(65) Prior Publication Data

US 2019/0241404 A1 Aug. 8, 2019

(30) Foreign Application Priority Data

Oct. 18, 2016 (EP) ..... 16194463

(51) Int. Cl.
*B66B 23/00* (2006.01)
*B66B 23/08* (2006.01)

(52) U.S. Cl.
CPC ..... *B66B 23/08* (2013.01); *B66B 23/00* (2013.01)

(58) Field of Classification Search
CPC ..... B66B 23/00; B66B 23/08; B66B 23/09
(Continued)

(56) References Cited

U.S. PATENT DOCUMENTS 3,513,780 A * 5/1970 Jenkins ..... B66B 23/10 198/844.2
4,126,218 A * 11/1978 El Taher ..... B66B 29/06 198/325

(Continued)

FOREIGN PATENT DOCUMENTS

| | | |
|---|---|---|
| EP | 0 885 832 B1 | 2/2003 |
| JP | S5243294 U | 3/1977 |
| JP | 2008 297056 A | 12/2008 |

OTHER PUBLICATIONS

International Search Report for International Application No. PCT/EP2017/075025 dated Dec. 1, 2017.

*Primary Examiner* — Douglas A Hess
(74) *Attorney, Agent, or Firm* — Knobbe Martens Olson & Bear LLP

(57) ABSTRACT

This application relates to a floor cover of a passenger-conveying device such as an escalator or a moving walkway. The floor cover has a plurality of cover elements and at least one coupling element. The coupling element is positioned between a first cover element and a second cover element. The coupling element has a coupling region configured to couple the first cover element to the second cover element for loading in tension and for angling relative to each other. The coupling element also has a restoring region configured to cause a restoring force between the first cover element and the second cover element as soon as one of the cover elements is raised upward in deviation from a desired configuration. The restoring force is directed in such a way that the raised cover element is acted upon toward the desired configuration.

19 Claims, 4 Drawing Sheets

(58) Field of Classification Search
USPC ..... 198/323, 324, 325
See application file for complete search history.

(56) References Cited

U.S. PATENT DOCUMENTS

| | | | | | |
|---|---|---|---|---|---|
| 4,565,276 | A * | 1/1986 | Dengs | B65G 17/34 | 198/321 |
| 5,372,231 | A * | 12/1994 | Volkening | B66B 23/00 | 198/325 |
| 5,440,843 | A * | 8/1995 | Langenhorst | E04F 19/08 | 49/463 |
| 5,628,391 | A * | 5/1997 | Volkening | B66B 23/00 | 198/325 |
| 5,971,129 | A * | 10/1999 | Stawniak | B66B 29/08 | 198/324 |
| 6,142,286 | A * | 11/2000 | Ulrich | B66B 29/06 | 198/325 |
| 6,644,457 | B2 * | 11/2003 | Lauch | B66B 29/06 | 198/322 |
| 7,537,101 | B2 * | 5/2009 | Aulanko | B66B 23/00 | 198/321 |
| 8,424,668 | B2 * | 4/2013 | Gonzalez Alemany | B66B 29/06 | 198/324 |
| 9,624,041 | B2 * | 4/2017 | Moor | B65G 45/14 | |
| 10,023,439 | B2 * | 7/2018 | Jussila | B66B 23/00 | |

* cited by examiner

FLOOR COVER FOR A PASSENGER-CONVEYING DEVICE

TECHNICAL FIELD

The present application relates to a floor covering for a passenger conveyor such as an escalator or a moving walkway. The application also relates to a passenger conveyor comprising a floor covering of this kind.

SUMMARY

Passenger conveyors such as escalators (sometimes also referred to as moving stairways) or moving walkways are used to transport persons along an inclined or horizontal travel path. At the entrance and/or exit of such a passenger conveyor, i.e., adjacent to the travel path, there is generally what is known as an underfloor space. Said underfloor space accommodates, for example, technical devices of the passenger conveyor, such as its drive unit, control unit, etc. In order for a person to be able to enter and leave the passenger conveyor easily and safely, said underfloor space is usually covered with a floor covering that can be walked on. However, since access to the devices located in the underfloor space should be possible, for example, for maintenance or repair purposes, the floor covering is usually designed so that it can be easily temporarily removed or opened by maintenance personnel, for example.

EP 0 885 832 B1 discloses a floor covering for a passenger conveyor which can be opened.

If floor coverings are provided with transverse grooves on their upwardly directed tread surface in order to prevent slipping, objects may get stuck in the transverse grooves. As a result, there is the possibility that unintentional lifting of the floor covering could occur in certain operating situations. For example, persons whose shoe heels hook into the floor covering could inadvertently apply forces to the floor covering such that it unintentionally lifts or even opens.

There may therefore be a need for a floor covering for a passenger conveyor in which inadvertent lifting or opening (force acting upward) is avoided or at least made more difficult. A suitably designed passenger conveyor may also be desired.

Such a desire may be addressed by the subject matter of this application. Advantageous embodiments are specified throughout the following description.

According to a first aspect of the application, a floor covering of a passenger conveyor for covering an underfloor space is described. The floor covering comprises, in a desired configuration, at least a first and a second planar cover element arranged one behind the other, and at least one coupling element. Each cover element comprises an upwardly directed tread surface and a first and a second end face at opposite ends. In the desired configuration, a first and a second cover element are arranged one behind the other such that a first end face of the first cover element is opposite a second end face of the second cover element. The coupling element is interposed between the first end face of the first cover element and the second end face of the second cover element. The coupling element comprises at least one coupling region that has a coupling pivot point. The coupling region is designed to couple the first cover element to the second cover element such that the first cover element and the second cover element are interconnected so as to be subjectable to upward tensile loading and so as to be able to bend relative to one another about the coupling pivot point.

At least one resilient restoring region is also formed on the coupling element, which region is arranged vertically below the coupling pivot point between the first cover element and the second cover element. Said resilient restoring region brings about a restoring force that acts on the adjacent end faces and is deflected by the coupling pivot point as soon as one of the cover elements is lifted upwards so as to deviate from its position in the desired configuration. In this case, the deflected restoring force is directed such that the lifted cover element is subjected to force towards its position in the desired configuration. In other words, the restoring force generated by the restoring region and deflected by the coupling pivot point counteracts the lifting force acting on one of the cover elements.

In the context of this application, the terms "up" and "down" or "upward" and "downward" refer to the position and orientation of the components of an operational passenger conveyor. Therefore, a force acting upward on the cover element counteracts the force of gravity at least in part, whereas a force acting downward is directed in the direction of the force of gravity or has a force vector oriented in the direction of the force of gravity.

According to a second aspect of the application, a passenger conveyor is described which comprises a conveyor unit for transporting persons along a travel path, an underfloor space adjacent to the travel path and a floor covering according to an embodiment of the first aspect of the application, which covers the underfloor space.

Possible features and advantages of embodiments of the application may be considered, inter alia and without limiting the invention, to be dependent upon the concepts and findings described below.

The floor covering of a passenger conveyor is intended to be temporarily removable or closable. For this purpose, it has previously been proposed to compose the floor covering from a plurality of cover elements and to interconnect said cover elements such that they are separable from one another or pivotable relative to one another. In this case, the entire floor covering is composed of the plurality of cover elements in the manner of segments, it being possible to raise the individual cover elements and optionally unfold them in order to be able to easily open the floor covering. The cover elements are planar, e.g., substantially two-dimensional, e.g., dimensions of the cover elements within a plane of extension are substantially greater than a thickness of the cover elements transversely to the plane of extension. Each cover element forms a tread surface on its upper side, over which surface a person can walk and which may be profiled, for example in order to reduce the risk of slipping, for example by transverse grooves provided therein. The cover elements may generally be planar or slightly curved. The cover elements should be sufficiently stable and able to support loads in order to withstand the forces exerted by persons passing thereover. The cover elements may for example consist of metal, in particular of aluminum, and may be produced for example by extrusion.

As already mentioned, it may be the case in certain situations that a floor covering of this kind is raised unintentionally, for example by a passenger inadvertently exerting an upwardly directed force on a cover element of the floor covering, for example, by hooking a shoe therein.

In an arrangement referred to herein as a "desired configuration," the cover elements are arranged one behind the other such that their tread surfaces adjoin one other, with respective end faces of adjacent cover elements being opposite one another. The desired configuration corresponds to the arrangement of the cover elements where said elements completely cover the underfloor space.

In conventional floor coverings for passenger conveyors, the cover elements were usually coupled together by coupling elements arranged therebetween, at least so as to be slightly subjectable to tensile loading. Optionally, the coupling elements were also designed so as to prevent adjacent metal cover elements rubbing directly against one other and thereby producing creaking noises, for example.

However, the depth of the transverse grooves had to be limited so that nothing could get stuck in the transverse grooves. As a result, the individual cover elements cannot be raised by exerting an upwardly directed force by which the gravitation acting thereon is overcome. However, limiting the depth of the transverse grooves reduces their effectiveness with respect to the risk of slipping, in particular at locations where a high level of dirt is to be expected.

Since it has been recognized that deeper transverse grooves promote inadvertent lifting or opening of elements of the floor covering, it is proposed herein not only to couple the cover elements together, but also to design a coupling element provided therefor such that inadvertent lifting of one of the cover elements is avoided or at least made more difficult.

For this purpose, the coupling element is provided with at least one so-called restoring region. Said restoring region is designed, in addition to the gravitational force acting on a cover element, to bring about a restoring force which is deflected by the coupling pivot point and is directed such that it counteracts lifting of the cover element. The restoring force is brought about as soon as an attempt is made to lift the cover element. The restoring force thus acts such that, when attempting to lift a cover element of the floor covering, said cover element is subjected to force such that it is loaded back into the predetermined desired configuration. Owing to the resilient design of the restoring region, the restoring force is brought about in an elastically resilient manner.

As explained above, the coupling element and the cover elements are designed such that the restoring region is arranged vertically below the coupling region or the coupling pivot point and is supported by the first end face of the first cover element and by the second end face of the second cover element.

In other words, the cover elements, at their opposing end faces, as well as the coupling element arranged between said end faces, are designed such that the restoring region of the coupling element is below the coupling region thereof, i.e., further away from the upwardly directed tread surface and the coupling pivot point arranged below the tread surface. The restoring region abuts, at its opposite sides, the respective end faces of the two opposing cover elements and is supported thereby.

If one of the cover elements is lifted close to the interface with an adjacent cover element, the two cover elements tend to tilt against one another in such a way that their end faces move away from one another above the coupling pivot point, i.e., close to the tread surface, and will move towards one another below the coupling pivot point. Such tilting counteracts the restoring region provided below the coupling pivot point of the coupling element. As a result, lifting of the cover element is ultimately counteracted.

According to one embodiment, the coupling element is made with polymer material. In particular, the coupling element may comprise a polymer material. In this way, the coupling element can be produced, inter alia, simply and cost-effectively, for example by injection molding methods.

According to one embodiment, the coupling element is made with or comprises polypropylene. Optionally, other polymer materials, additives or the like may be added to the polypropylene in order to be able to vary its properties, such as its hardness and/or strength, in a region-dependent manner.

According to one embodiment, the coupling element is formed integrally. In other words, the coupling element can be provided as a single component and can integrate and include both the coupling region and the restoring region. The coupling element can thus be produced cost-effectively and simply, for example, by injection molding. Storage, logistics and/or assembly costs can also be reduced.

According to one embodiment, the coupling element is formed in the restoring region with a material having a Shore A hardness of more than 65, preferably more than 70, and more preferably more than 75. The coupling element is therefore preferably relatively hard or firm, at least in the restoring region. This allows a strong restoring force to be brought about without resulting in significant deformations.

According to one embodiment, the coupling element is formed in the coupling region with a material having a Shore A hardness of less than 65, preferably less than 60, and more preferably less than 50. The coupling element can therefore preferably be relatively flexible in the coupling region. In particular, the coupling element may be made with a more flexible material in its coupling region than in its restoring region. The coupling region can thus be easily deformed locally, for example, in order to be able to lock it into one of the cover elements.

According to one embodiment, the floor covering further comprises a damping element interposed between the first end face of the first cover element and the second end face of the second cover element in a region in which the first and the second end face are minimally spaced from one another in the case of the desired configuration of the floor covering.

In other words, a damping element can be provided between two adjacent cover elements. Said damping element can absorb, for example, longitudinal forces acting between said cover elements. The damping element can prevent for example metal surfaces of the two adjacent cover elements from directly abutting one another other and, in the process, prevent creaking noises and/or wear from occurring as a result of said metal surfaces rubbing against one another. The damping element is preferably provided at a position in which the opposing end faces of the two adjacent cover elements are minimally spaced from one other, that is to say a gap between the adjacent cover elements has minimal dimensions. This means that the damping element can be designed to be relatively thin.

According to a special configuration of this embodiment, the damping element is made with a material which has a greater hardness than a material with which the coupling element is formed in its restoring region. On account of its greater hardness, the damping element can withstand high compressive forces, such as can occur between the cover elements, for example due to thermally induced dimensional changes. For example, a hardness of the material used for the damping element can be greater than the hardness of the material used for the restoring region of the coupling element by at least 5%, preferably at least 10%, or at least 20%, or can exceed the hardness of said material by at least 5, preferably at least 10, Shore A degrees of hardness, for example.

According to a special configuration of this embodiment, the damping element is made with polyamide or comprises polyamide. Polyamide is a relatively hard, durable polymer material that can be produced and processed simply and cost-effectively.

According to a special configuration of this embodiment, the damping element is attached to the coupling element. In other words, the damping element can be fastened directly to the coupling element. A unit consisting of or comprising the damping element and coupling element can thus be jointly produced, stored, handled and finally installed.

According to one embodiment, the damping element is preferably integral with the coupling element. This means that the damping element may be an integral component of the coupling element. In this case, the damping element can protrude, for example, from the coupling region of the coupling element. The damping element, which preferably consists of polymer material, can for example be molded onto a region of the coupling element in an integrally bonded manner. In this case, the damping element may (but does necessarily have to) comprise a different polymer material than the regions of the coupling element. For example, the damping element may comprise polyamide, whereas the coupling region and the restoring region of the coupling element preferably comprise polypropylene.

It should be noted that some of the possible features and advantages of the invention are described with reference to different embodiments, in particular in part with reference to a floor covering and in part with reference to a passenger conveyor. A person skilled in the art recognizes that the features may be combined, adapted, transferred or exchanged as appropriate in order to yield other embodiments of the invention.

BRIEF DESCRIPTION OF THE DRAWINGS

Embodiments of the disclosure will be described in the following with reference to the accompanying drawings, with neither the drawings nor the description being intended to be interpreted as limiting the invention.

The drawings are merely schematic and not true to scale. Like reference signs refer to like or equivalent features in the various drawings.

DETAILED DESCRIPTION

Figure 1:
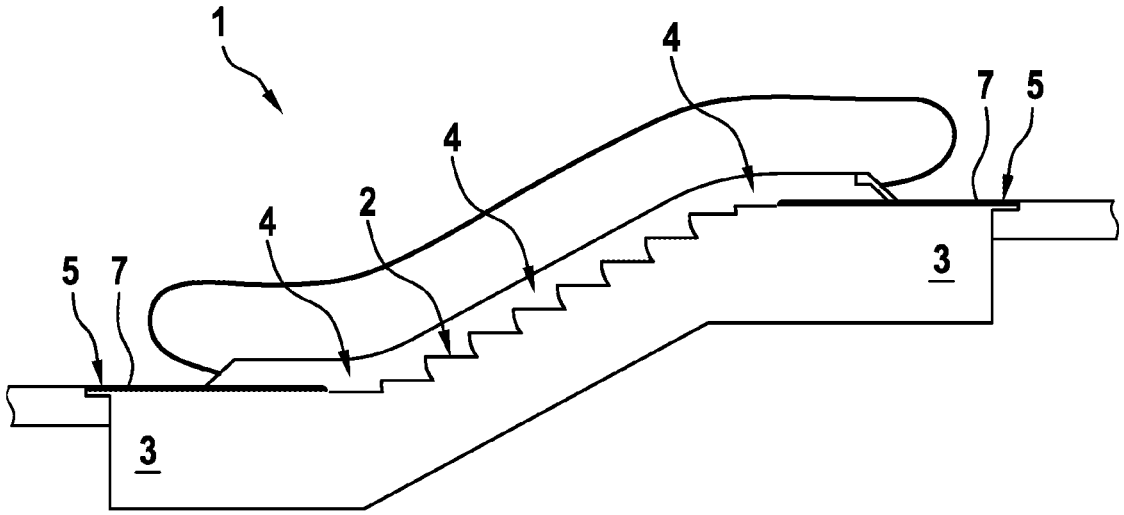
FIG. 1 shows a passenger conveyor.

FIG. 1 shows a passenger conveyor 1 in the form of an escalator. A conveyor unit 2 can transport persons along a travel path 4. An underfloor space 3 is provided at both an upper and a lower end of the escalator, in which space for example a drive, a controller, etc. (not shown) are accommodated. Each underfloor space 3 is covered with a floor covering 5 so that persons can walk over a tread surface 7 formed thereby and can enter and exit the escalator.

Figure 2:
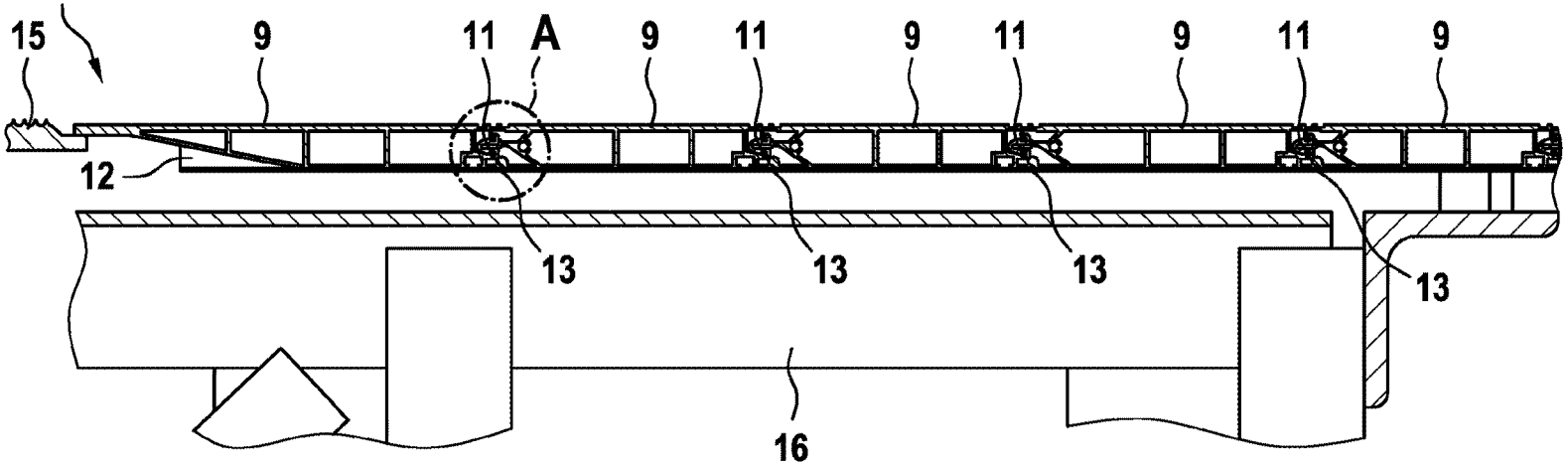
FIG. 2 is a sectional view through a floor covering of a passenger conveyor.

FIG. 2 is an enlarged sectional view through a floor covering 5. The floor covering 5 is composed of a plurality of planar cover elements 9. The cover elements 9 are arranged, in the desired configuration shown, one behind the other in a common plane, first and second end faces 11, 13 of adjacent cover elements 9 being opposite one another. The foremost cover element 9 (on the far left-hand side in the figure) is tapered and adjoins a comb plate 15. A support structure 16 supports the floor covering 5.

Figure 3:
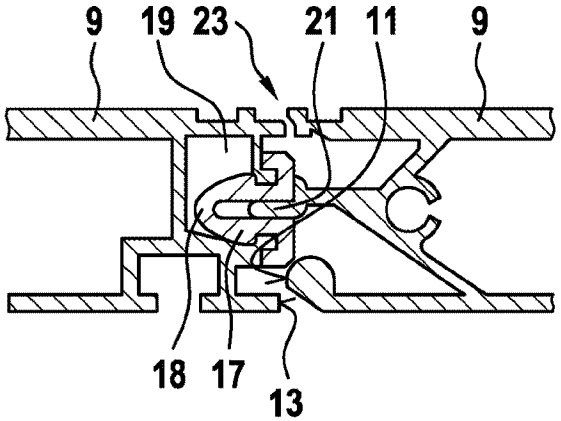
FIG. 3 is a sectional view through two cover elements of a conventional floor covering that are coupled together.

FIG. 3 is a sectional view through two cover elements 9 of a conventional floor covering, as an enlargement of the region "A" from FIG. 2. The two cover elements 9 adjoin one another along a boundary line 23 by their first or second end faces 11, 13. In the process, a coupling element 17 engages in a cavity 19 in the first cover element 9 by means of a lug 18 and is form-fittingly locked therein. On the other hand, a projection 21 on the opposite, second cover element 9 engages from an opposite side into the Q-shaped lug 18 of the coupling element 17.

The two cover elements 9 are interconnected by means of the coupling element 17 so as to be subjectable to tensile loading. The cover elements 9 can, however, be tilted relative to one another when lifted at one point. This is used in particular to be able to fold away the cover elements 9 in order, for example, to locally remove the floor covering 5 during a maintenance operation and to be able to expose the underlying underfloor space 3.

If, however, the transverse grooves were deeper for the purpose of improving the slip resistance, and a shoe heel became stuck therein as a result, this could lead, in addition to such unintentional removal of the floor covering 5, to unintentional lifting of the cover elements 9 thereof.

Figure 4:
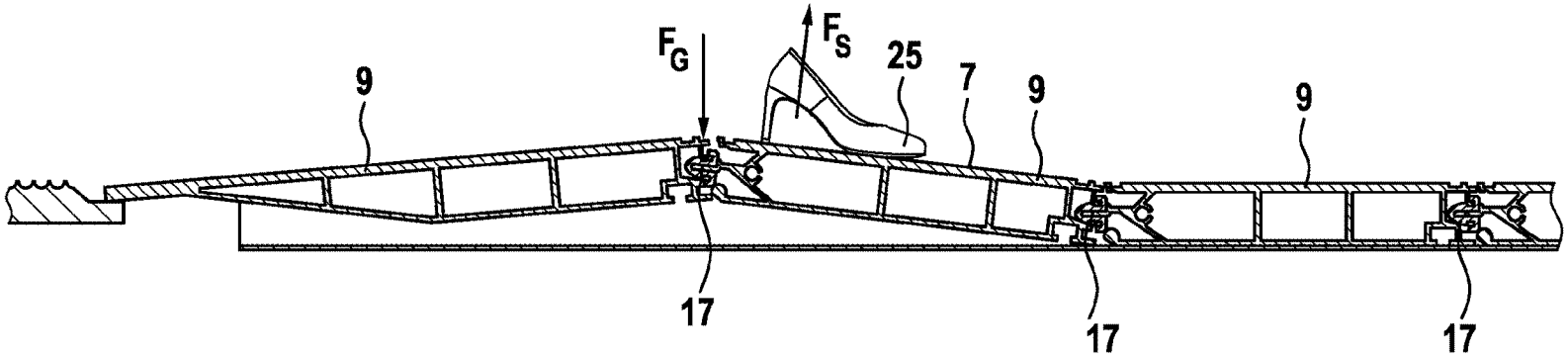
FIG. 4 illustrates unintentional lifting of a cover element of a floor covering.

FIG. 4 shows, by way of example, how a shoe 25 hooks with its heel into transverse grooves of a cover element 9 on its tread surface 7, and then a force $F_S$ is exerted on the cover element 9 by the person wearing the shoe 25. Since said force $F_S$ conventionally counteracts only the gravitational force $F_G$ of the cover element 9, it may be the case that both the cover element 9 in which the shoe 25 has become hooked and a cover element 9 adjacent thereto are locally raised.

In order to avoid such unintentional local lifting of cover elements 9, or at least make it more difficult, it is proposed here to couple two cover elements 9 together by means of a specially developed coupling element 17, in which a restoring force is generated in a targeted manner when one of the cover elements 9 is lifted, which force loads the lifted cover element 9 back to the desired configuration.

Figure 5:
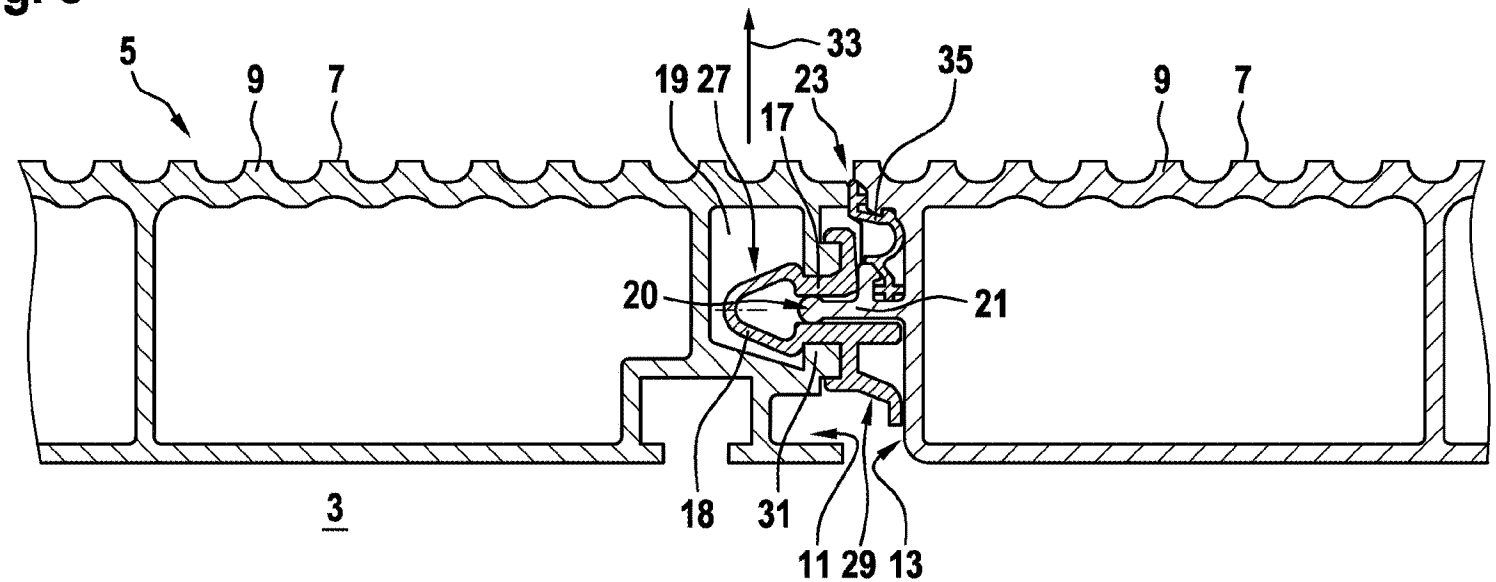
FIG. 5 is a sectional view through two cover elements of a floor covering that are coupled together, according to one embodiment of the present invention.

FIG. 5 shows, by way of example, a coupling element 17 according to the disclosure which couples two adjacent cover elements 9. The coupling element 17 is interposed between the opposing end faces 11, 13 of the two cover elements 9. The coupling element 17 comprises both a coupling region 27 and a restoring region 29. The coupling region 27 and the restoring region 29 are integrated in a single component forming the coupling element 17.

The coupling region 27 may be formed similarly to the conventional coupling element 17 shown in FIG. 3. A lug 18 can engage in a cavity 19 in the first cover element 9 by way of an undercut and can be form-fittingly locked therein. A projection 21 protruding from the second cover element 9 on the second end face 13 thereof can be inserted into the lug 18 from behind, optionally by friction. In this way, the coupling region 27 can interconnect the two cover elements 9 so as to be sufficiently subjectable to upward tensile loading. The coupling region 27 is designed such that the two cover elements 9 can be tilted relative to one another. To enable this, there is sufficient local clearance between the projection 21 and the coupling element 17 in the form of a coupling pivot point 20. In other words, this means that two adjacent cover elements 9 are coupled such that the first cover element 9 and the second cover element 9 are interconnected so as to be subjectable to upward tensile loading and so as to be able to bend relative to one another about the coupling pivot point 20.

The restoring region 29 is integrally formed on the coupling element 17, vertically below the coupling region 27 or the coupling pivot point 20. The restoring region 29 is adapted to the geometry of the two end faces 11, 13 of the opposing cover elements 9 such that said region is supported on one side by the first end face 11 of the first cover element 9 and on the opposite side by the second end face 13 of the second cover element 9. In the example shown, in addition, a protruding region 31 is formed on the first end face 11, against which region the restoring region 29 can be supported. An opposite end of the restoring region 29 lies on the second end face 13 and is supported there.

As soon as one of the cover elements 9 is lifted close to the boundary line 23 between two cover elements 9, as illustrated by the lifting movement direction 33, the two cover elements 9 attempt to tilt one another about the coupling pivot point 20. Due to the fact that, on the one hand, the coupling element 17 interconnects the two cover elements 9 by means of its coupling region 27 such that said regions are subjectable to upward tensile loading and, on the other hand, the restoring region 29 is supported below the coupling pivot point 20 on both sides by the opposing end faces 11, 13 of the two cover elements 9, a restoring force is brought about which is deflected by the coupling pivot point 20 and counteracts the upwardly directed force acting in the direction of the arrow 33. In this way, it can at least be made more difficult for the cover elements 9 to be unintentionally pulled upward.

It may optionally be advantageous to form the coupling region 27 with a more flexible material than the restoring region 29. The coupling region 27 can be formed, for example, with a Shore A hardness of from 50 to 60, whereas the restoring region 29 can be formed with a Shore A hardness of from 70 to 75. As a result, on the one hand, for example, the lug 18 can be inserted and locked in the cavity 19 more easily and the process of inserting the projection 21 from behind into the lug 18 can also be improved. On the other hand, the harder, and thus stronger, restoring region 29 can provide more stable support and a higher restoring force between the two cover elements 9.

For example, the entire coupling element 17 may be made with a polymer material such as polypropylene, or may consist of or comprise polypropylene, at least in regions. It may be advantageous for the different regions to be formed, for example, by adding additives of variable hardness.

As can be seen in FIG. 5, a damping element 35 is interposed between the two cover elements 9, in addition to the coupling element 17. The damping element 35 is interposed at a position between the opposing end faces 11, 13 of the two cover elements 9 at which said elements are minimally spaced apart from one another. In the embodiment shown, this is in a region directly adjacent to the tread surfaces 7. The damping element 35 is intended to prevent regions of the cover elements 9 which are typically made of metal from directly adjoining one another and thus, during movements of the two cover elements 9 relative to one another, from rubbing against one another and generating disruptive noises. Optionally, the damping element 35 may also be used as a sealing lip between the adjacent cover elements 9 in the region of the boundary line 23.

As with the coupling element 17, the damping element 35 can also be made with polymer material. It may nevertheless be advantageous to make the damping element 35 with a harder material than the coupling element 17. For example, the damping element 35 may be made with hard polyamide.

Figure 6:
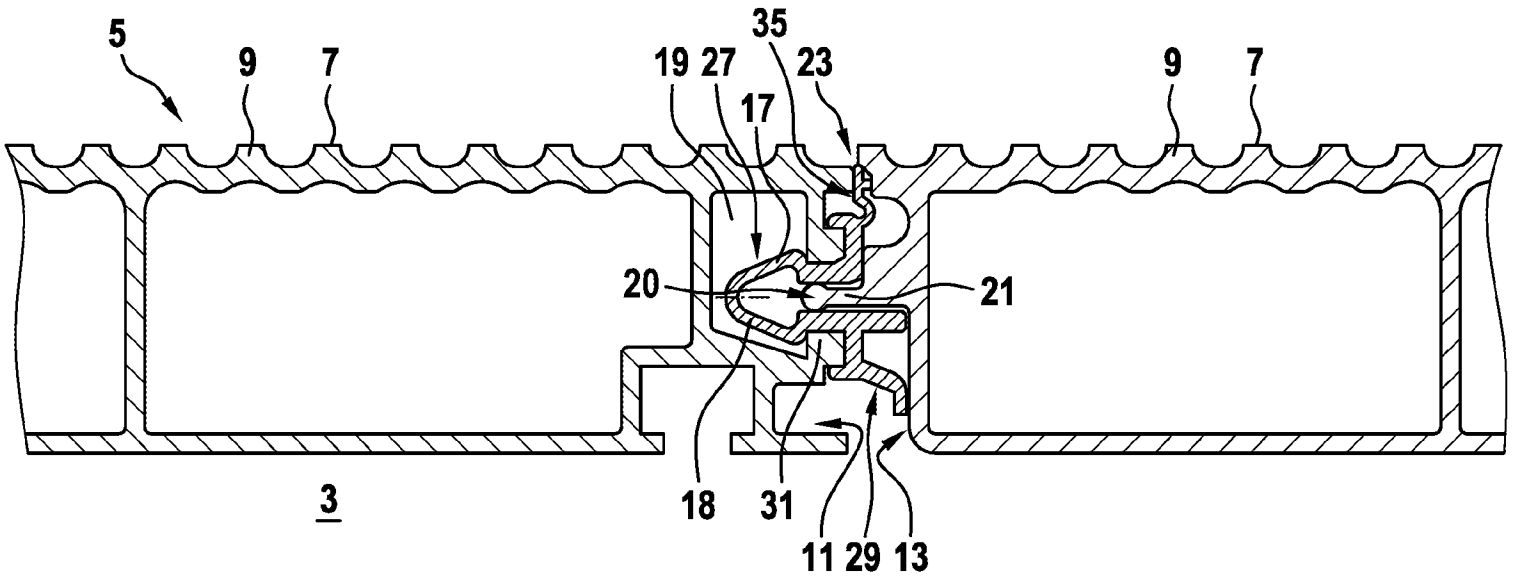
FIG. 6 is a sectional view through two cover elements of a floor covering that are coupled together, according to a further embodiment of the present invention.

While in the embodiment shown in FIG. 5 the coupling element 17 and the damping element 35 are provided as two separate components, these elements are formed as a single integrated component in the embodiment shown in FIG. 6. A further extension is formed on the coupling element 17 vertically above the coupling region 27 or the coupling pivot point 20, which extension is used as a damping element 35 and extends in the region of the boundary line 23 between the closely adjacent regions of the two opposing end faces 11, 13 of the cover elements 9 to be coupled by means of the coupling element 17.

Although the coupling element 17 can also be formed integrally in this case and can be produced, for example, by injection molding, it may also be possible in such an embodiment to design the region of the damping element 35 with a harder material than the coupling region 27 and/or the restoring region 29. In particular, different materials can also be used in a common component. By means of modern injection molding methods, for example, the coupling region and the restoring region 27, 29 can be formed with polypropylene, whereas the region of the damping element 35 can be formed with harder polyamide.

Finally, it should be noted that terms such as "comprising," "having," etc. do not preclude other elements or steps and terms such as "a" or "an" do not preclude a plurality. Furthermore, it should be noted that features or steps that have been described with reference to one of the above embodiments may also be used in combination with other features or steps of other embodiments described above. Reference signs in the claims should not be considered to be limiting.

The invention claimed is:

1. A floor covering for a passenger conveyor configured to cover an underfloor space, the floor covering comprising:

at least a first and a second planar cover element arranged one behind the other, each cover element comprising an upwardly directed tread surface and a first and second end face at opposite ends;

a coupling element, the coupling element being interposed between the first end face of the first cover element and the second end face of the second cover element, the coupling element comprising at least one coupling region that has a coupling pivot point, and the coupling region being designed to couple the first cover element to the second cover element such that the first cover element and the second cover element are interconnected so as to be subjectable to upward tensile loading and so as to be able to bend relative to one another about the coupling pivot point, wherein at least one resilient restoring region is formed on the coupling element, which resilient restoring region is arranged vertically below the coupling pivot point between the first cover element and the second cover element in order to bring about a restoring force that acts on the adjacent end faces and is deflected by the coupling pivot point as soon as one of the cover elements is lifted upwards so as to deviate from its position in the desired configuration, the deflected restoring force being directed such that the lifted cover element is subjected to force towards its position in the desired configuration.

2. The floor covering of claim 1, wherein the coupling element is made with polymer material.

3. The floor covering of claim 1, wherein the coupling element is made with polypropylene.

4. The floor covering of claim 1, wherein the coupling element is integrally formed.

5. The floor covering of claim 1, wherein the coupling element is formed with a material having a Shore A hardness of more than 65 in the restoring region.

6. The floor covering of claim 1, wherein the coupling element is formed with a material having a Shore A hardness of less than 65 in the coupling region.

7. The floor covering of claim 1, wherein the floor covering further comprises a damping element interposed between the first end face of the first cover element and the second end face of the second cover element in a region in which the first and the second end face are minimally spaced from one another in the case of the desired configuration of the floor covering.

8. The floor covering of claim 7, wherein the damping element is made with a material which has a greater hardness than a material with which the coupling element is formed in its restoring region.

9. The covering of claim 7, wherein the damping element is made with polyamide.

10. The floor covering of claim 7, wherein the damping element is attached to the coupling element.

11. The floor covering according of claim 7, wherein the damping element is integral with the coupling element.

12. A passenger conveyor, comprising:

a conveyor unit for transporting persons along a travel path;

an underfloor space adjacent to the travel path; and a floor covering configured to cover the underfloor space, wherein the floor covering comprises:

at least a first and a second planar cover element arranged one behind the other, each cover element comprising an upwardly directed tread surface and a first and second end face at opposite ends;

a coupling element, the coupling element being interposed between the first end face of the first cover element and the second end face of the second cover element, the coupling element comprising at least one coupling region that has a coupling pivot point, and the coupling region being designed to couple the first cover element to the second cover element such that the first cover element and the second cover element are interconnected so as to be subjectable to upward tensile loading and so as to be able to bend relative to one another about the coupling pivot point, wherein at least one resilient restoring region is formed on the coupling element, which resilient restoring region is arranged vertically below the coupling pivot point between the first cover element and the second cover element in order to bring about a restoring force that acts on the adjacent end faces and is deflected by the coupling pivot point as soon as one of the cover elements is lifted upwards so as to deviate from its position in the desired configuration, the deflected restoring force being directed such that the lifted cover element is subjected to force towards its position in the desired configuration.

13. The passenger conveyor of claim 12, wherein the coupling element is made with polymer material.

14. The passenger conveyor of claim 12, wherein the coupling element is formed with a material having a Shore A hardness of more than 65 in the restoring region.

15. The passenger conveyor of claim 12, wherein the coupling element is formed with a material having a Shore A hardness of less than 65 in the coupling region.

16. The passenger conveyor of claim 12, wherein the floor covering further comprises a damping element interposed between the first end face of the first cover element and the second end face of the second cover element in a region in which the first and the second end face are minimally spaced from one another in the case of the desired configuration of the floor covering.

17. The passenger conveyor of claim 16, wherein the damping element is made with a material which has a greater hardness than a material with which the coupling element is formed in its restoring region.

18. The passenger conveyor of claim 16, wherein the damping element is attached to the coupling element.

19. The passenger conveyor of claim 16, wherein the damping element is integral with the coupling element.

* * * * *